US008686330B2

(12) United States Patent
Johansson

(10) Patent No.: US 8,686,330 B2
(45) Date of Patent: Apr. 1, 2014

(54) SHELL ARRANGED WITH EXTENSIBLE WINGS AND GUIDING DEVICE

(75) Inventor: Nils Johansson, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 0 days.

(21) Appl. No.: 13/580,874

(22) PCT Filed: Feb. 24, 2011

(86) PCT No.: PCT/SE2011/000037

§ 371 (c)(1),
(2), (4) Date: Nov. 5, 2012

(87) PCT Pub. No.: WO2011/105949

PCT Pub. Date: Sep. 1, 2011

(65) Prior Publication Data

US 2013/0048778 A1 Feb. 28, 2013

(30) Foreign Application Priority Data

Feb. 25, 2010 (SE) ..... 1000179

(51) Int. Cl.
*F42B 10/64* (2006.01)
*F42B 10/60* (2006.01)
*F42B 10/00* (2006.01)

(52) U.S. Cl.
USPC ..... 244/3.28; 244/3.24; 244/3.27; 244/3.29

(58) Field of Classification Search
USPC ..... 244/3.1–3.3, 34 R, 35 R, 45 R, 46, 49; 102/382, 384, 386, 473, 490, 501
See application file for complete search history.

(56) References Cited

U.S. PATENT DOCUMENTS

| | | | | | |
|---|---|---|---|---|---|
| 1,448,166 | A | | 3/1923 | Strong | |
| 4,145,017 | A | * | 3/1979 | Stiklorus | 244/3.25 |
| 4,210,298 | A | * | 7/1980 | Liberman | 244/3.21 |
| 4,336,914 | A | * | 6/1982 | Thomson | 244/3.27 |
| 4,533,094 | A | * | 8/1985 | Geis et al. | 244/3.22 |
| 4,588,146 | A | * | 5/1986 | Schaeffel et al. | 244/3.27 |
| H685 | H | | 10/1989 | Olson et al. | |
| 5,037,040 | A | * | 8/1991 | Goltz et al. | 244/3.22 |
| 5,398,887 | A | * | 3/1995 | Wassom et al. | 244/3.22 |
| 5,439,188 | A | * | 8/1995 | Depew et al. | 244/3.21 |
| 5,467,940 | A | * | 11/1995 | Steuer | 244/3.11 |

(Continued)

FOREIGN PATENT DOCUMENTS

| | | | | |
|---|---|---|---|---|
| DE | 4019414 A1 | | 2/2000 | |
| EP | 1092941 A1 | * | 4/2001 | F42B 10/64 |
| FR | 2768807 A1 | | 3/1999 | |

*Primary Examiner* — Bernarr Gregory
(74) *Attorney, Agent, or Firm* — Novak Druce Connolly Bove + Quigg LLP

(57) ABSTRACT

The invention relates to a shell (1) arranged with extensible wings (3) having improved guidance characteristics during the gliding and final phase of the shell (1). The invention is characterized in that the extensible wings (3), via threaded wing fixtures (8), are movably arranged on rotatable axial guide shafts (6) on the shell body (2) for separate or simultaneous displacement of the wings (3) in the longitudinal direction A of the shell (1), for guidance of the shell (1) in the vertical and lateral directions during the trajectory phase of the shell, and in that the wings (3) are also rotatably arranged on radial guide shafts for controlling the angle of incidence of the wings (3) during the final phase of the shell (1).

20 Claims, 4 Drawing Sheets

(56) References Cited

U.S. PATENT DOCUMENTS

| | | | | |
|---|---|---|---|---|
| 5,775,636 | A * | 7/1998 | Vig et al. | 244/3.24 |
| 5,780,766 | A * | 7/1998 | Schroppel | 244/3.27 |
| 6,056,237 | A * | 5/2000 | Woodland | 244/3.15 |
| 6,237,496 | B1 * | 5/2001 | Abbott | 102/384 |
| 6,260,797 | B1 * | 7/2001 | Palmer | 102/501 |
| 6,726,147 | B1 | 4/2004 | Perini et al. | |
| 6,981,672 | B2 * | 1/2006 | Clancy et al. | 244/3.24 |
| 7,185,847 | B1 * | 3/2007 | Bouchard et al. | 244/3.28 |
| 7,354,017 | B2 * | 4/2008 | Morris et al. | 244/3.23 |
| 7,728,267 | B2 * | 6/2010 | Sanderson et al. | 244/3.27 |
| 8,237,096 | B1 * | 8/2012 | Alexander et al. | 244/3.25 |
| 2004/0021034 | A1 | 2/2004 | Hellman | |

* cited by examiner

SHELL ARRANGED WITH EXTENSIBLE WINGS AND GUIDING DEVICE

CROSS REFERENCE TO RELATED APPLICATIONS

This application is a National Phase filing under 35 U.S.C. §371 of PCT/SE2011/000037 filed on Feb. 24, 2011; and this application claims priority to Application No. 1000179-0 filed in Italy on Feb. 25, 2010 under 35 U.S.C. §119; the entire contents of all are hereby incorporated by reference.

TECHNICAL FIELD

The present invention relates to a shell arranged with extensible wings having improved guidance characteristics during the gliding and final phase of the shell, which shell is intended for firing from a firing device, preferably a mortar.

BACKGROUND

Shells which are fired from a conventional mortar achieve a maximum range of about 8 km. These shells are unguided and therefore have a fairly large spread in respect of a target.

By providing such a shell with wings and a guiding device, the range of fire can be considerably extended, at the same time as the impact accuracy is improved. Shells which are arranged with extensible wings for increased range of fire have long been known. Patent specification U.S. Pat. No. 130,078, FIG. 1, shows a shell having extensible wings 11, which wings are extended directly after firing from a launcher. The wings lie retracted against the outer side of the shell body and are pretensioned with a spring mechanism, which is activated mechanically after the shell has passed through the launcher.

By virtue of patent specification WO9846962 A1, it is also known to use time-delayed extension of the wings on a shell or missile. The wings of the shell can thus be extended, for example, only once the shell has reached its maximum flying height or summit of trajectory, in order subsequently to glide in the downward part of the flight path.

The time delay can be pre-programmed or activated via an internal GPS system. The time delay can also be remote-controlled from a ground-based target radar, with account being taken of changed target conditions, or if shells are fired in sequence.

Small wings give limited gliding ratio with relatively high trajectory speed, which gives moderately long trajectory times. The gliding ratio is the ratio between the flight distance ahead and the reduction in flight height. Typically, the gliding ratio for winged shells or missiles lies in the order of magnitude of 3-6. Large airliners have a gliding ratio in the order of magnitude of 15, and extreme gliders have a gliding ratio above 60. For a shell having wings which are extended at the summit of trajectory of the shell for gliding toward a target, a gliding ratio of about 4 implies an extended range of fire from about 8 km to about 16 km compared with a wingless shell.

Guidance of conventional aircraft can be easily described such that a rudder in the tail of the aircraft makes deviations which change the angle of incidence of the aircraft and thus of the wing to the flowing air. A change in the angle of incidence of the wing changes the lift of the aircraft and thus the flight path of the aircraft. The rudder can be placed in front of the wing or behind the wing. It is harder to achieve good flight stability, however, when the rudder is placed in front of the wing, so that a configuration is normally chosen in which the rudder is placed in the tail of the aircraft. In patent specification U.S. Pat. No. 5,780,760, a mortar shell having extensible gliding wings and a guiding device arranged in the tail of the shell are described.

For a mortar shell, it is impractical to have a guiding device, such as, for example, fins, arranged in the tail of the shell, since the fins are subjected to high pressures and temperatures from the burning propellant powder charge of the shell. Fins are therefore normally arranged in the nose of the mortar shell.

The drawback with fins in the nose of the shell is, however, limited guiding facilities, resulting in worse flight stability, as well as a complicated construction due to double sets of wings.

BRIEF DESCRIPTION OF INVENTION

A main object of the present invention is a shell having extensible wings and improved guiding function during the gliding and final phase of the shell.

A further object of the present invention is a simplified shell with fewer parts at lower cost.

The said objects, and other objects which are not enumerated here, are satisfactorily met by virtue of that which is specified in the present independent patent claims. Embodiments of the invention are specified in the independent patent claims.

Thus, according to the present invention, a mortar shell arranged with extensible wings having improved guidance characteristics during the gliding and final phase of the shell has been provided.

The mortar shell is characterized:

in that the extensible wings, via threaded wing fixtures, are movably arranged on rotatable axial guide shafts on the shell body for separate or simultaneous displacement of the wings in the longitudinal direction of the shell, for guidance of the shell in the vertical and lateral directions during the trajectory phase of the shell, and in that the wings are also rotatably arranged on radial guide shafts for controlling the angle of incidence of the wings during the final phase of the shell.

According to further aspects of the mortar shell, it is the case according to the invention:

that the wings are retracted against the shell body during firing of the shell, and that the wings are extended from the shell body when a release mechanism is activated, the wings also being arranged rotatably in order to control the angle of incidence of the wings during the final phase of the shell, that the release mechanism is activated on a pre-programmed basis via a programmable command and control unit arranged in the shell body, the wings are retracted against the shell body during firing of the shell, and that the wings are extended from the shell body when a release mechanism arranged in the fastening of the wings is activated, that the release mechanism is activated on a pre-programmed basis via a programmable command and control unit arranged in the shell body, that the release mechanism is activated by remote control in response to an activation signal from a ground-based transmitter, that the release mechanism is electromechanical, that the release mechanism is pyrotechnic, that the wings are hinged to allow the shape of the wings to be adapted to the shape of the shell body when the wings are retracted against the shell body, that rotation of the guide shafts is effected with electric motors, the torque of which is transferred to the guide shafts via flexible rotary shafts, that activation of the electric motors is realized in response to control signals from a ground-based transmitter via the programmable command and control unit.

ADVANTAGES AND EFFECTS OF THE INVENTION

The invention implies a number of advantages and effects: the unique construction in which the wings, independently of one another, can be axially adjusted for guidance of the shell in the vertical and lateral directions, and the facility to rotate the wings in order to set the angle of incidence of the shell during its final phase, mean an improved guide function which normally calls for separate gliding wings and fins.

The construction comprising hinged wings to allow the wings to be adapted to the shape of the shell body when these are retracted against the outer side of the shell body means a simple and flexible wing construction in which no extra space is required in the shell body in order to accommodate the wings.

The basic concept behind the invention is thus a shell with extensible wings, in which the wings are configured with a guide function for the gliding phase and final phase of the shell.

The invention has been defined in the following patent claims and will now be described in somewhat greater detail in connection with the appended figures.

BRIEF DESCRIPTION OF DRAWINGS

Further advantages and effects will emerge in the course of study and consideration of the following, detailed description of the invention, with simultaneous reference to the figures in which.

DESCRIPTION OF BEST AND VARIOUS MODES FOR CARRYING OUT INVENTION

Figure 1:
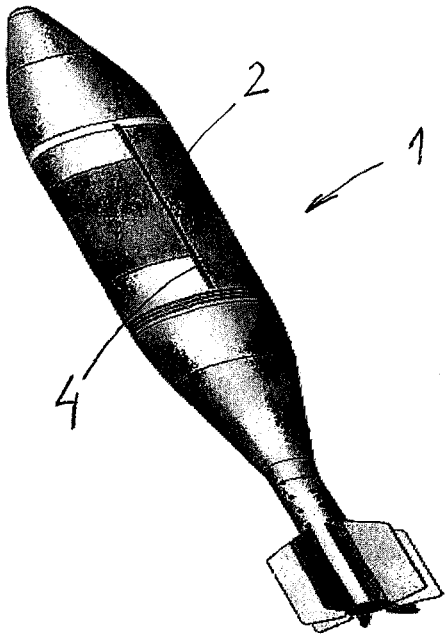
FIG. 1 shows in schematic representation a side view of a shell prior to firing from a mortar, wherein the wings are retracted against the outer side of the shell body.
Figure 2:
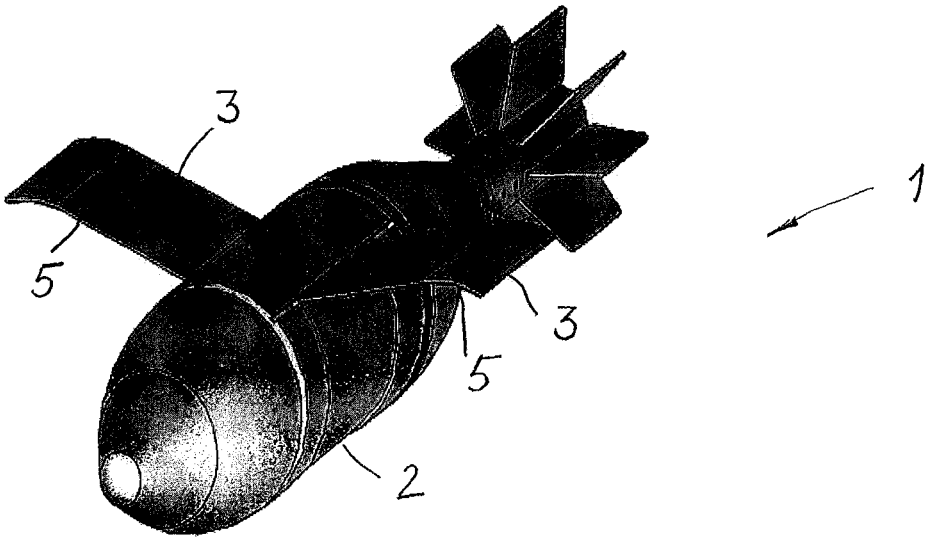
FIG. 2 shows in schematic representation a side view of a shell according to FIG. 1, viewed obliquely from the rear after the shell has been fired from the mortar, wherein the wings are extended from the shell body.

FIGS. 1 and 2 show in schematic representation side views of a mortar shell 1 comprising two wings 3, which are extensible in the shell body 2. The wings 3 are arranged such that they are movable in the axial direction, via the guide grooves 4, on rotatably arranged guide shafts 6. FIG. 1 shows the shell 1 prior to firing from a mortar, with the wings 3 lying retracted against the outer side of the shell body 2. FIG. 2 shows the shell 1 after firing from the mortar, with the wings 3 having been extended from the shell body 2. The wings 3, which are pretensioned, are extended with a spring mechanism, which holds the wings 3 in the extended position. The spring mechanism is constituted by springs arranged on the rotatably arranged guide shafts 6 inside the shell body 2, FIG. 7. A release mechanism for activation of the spring mechanism comprises an electric or electromechanical switch connected to the spring mechanism, which release mechanism, when activated, triggers the spring mechanism, for example through the activation or breaking of an electric circuit.

The release mechanism can also comprise a pyrotechnic charge, which, when initiated, activates a mechanical catch which triggers the spring mechanism. Activation of the release mechanism can be realized on a pre-programmed basis via a programmable command and control unit in the shell 1, or by remote control via a signal from a ground-based transmitter. Alternatively, activation can be realized via a pre-programmed detonating fuse.

By displacing the wings 3 forwards or backwards relative to the centre of gravity of the shell 1, the same manoeuvring options are obtained as in guidance with a conventional rudder. The wings 3 lie retracted against the shell body 2 when the shell 1 is loaded into a mortar, during the firing process when the shell 1 is fired from the mortar, and during the travel of the shell 1 to maximum flight height, or to the summit of its trajectory. Immediately after the shell has reached the summit of its trajectory, the wings 3 are extended on command from a programmable command and control unit. The command can be decided upon autonomously in real time, can be pre-programmed or can come from a ground transmitter. During the gliding phase of the shell 1, repeated corrections of the flight path of the shell 1 are realized by virtue of the fact that an internal guide mechanism corrects the positions of the wings 3 in the axial direction, in response to control signals from the programmable command and control unit. The guidance of the shell 1 can be realized either on a pre-programmed basis in real time, via, for example, GPS and an internal target sensor, or by remote control, via control signals from an external transmitter, which can be ground-based.

The wings 3, which can be made of sheet metal, are retracted around the shell body 2, and are extended from the shell body 2 only once the release mechanism has been activated. The wings 3 are preferably gently bent to follow the curvature of the shell body 2 when the wings 3 are retracted. Alternatively, the wings 3 can be hinged, firstly in the fastening in the shell body 2 and secondly at one or more positions 5 in the wings 3. The shell 1 is aerodynamically stable and flies at stabilized speed with extended wings 3 up to the target of the shell 1, where the warhead of the shell 1 is activated.

Figure 7:
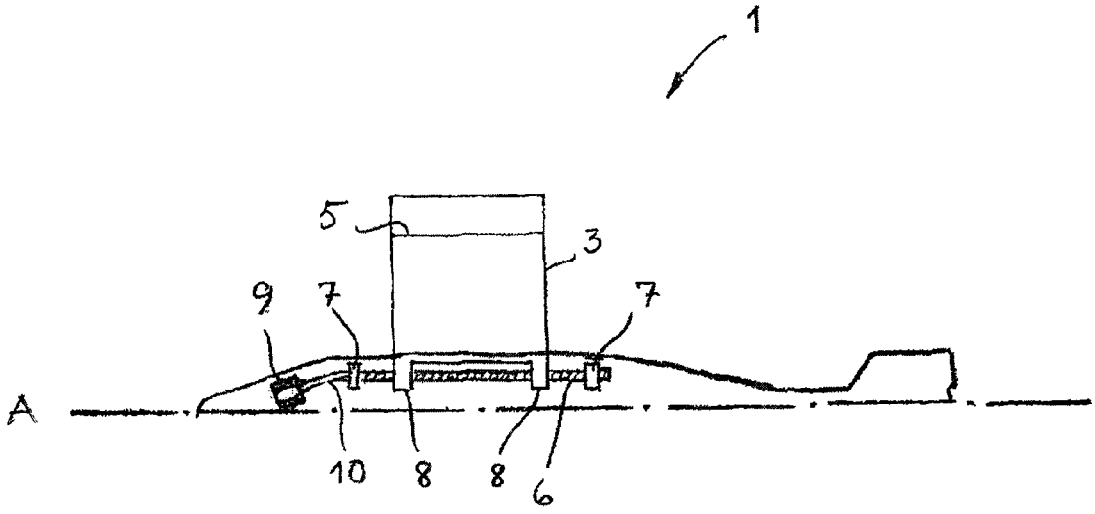
FIG. 7 shows in schematic representation a longitudinal section of a shell according to FIG. 2, in which the main parts in a mechanism for displacing the wings in the axial direction can be seen.

FIG. 7 shows the main parts of the guide mechanism of the shell for displacing the wings 3 forwards or backwards in the shell 1. The wings 3 are disposed on guide shafts 6 axially arranged in the shell body 2. The guide shafts 6 are constituted, preferably, by rotatable screws arranged on threaded fastenings 7 in the shell body 2. The wings 3 are displaced on the rotatable guide shafts 6 via threaded nuts 8, the rotation of the screws, clockwise or anti-clockwise, being effected with a turning device 9, preferably via electric motors. The torque of the electric motors is transferred to the guide shafts 6 via flexible rotary shafts 10. Alternatively, the rotation of the guide shafts 6 is effected electromagnetically with the aid of electromagnetic solenoids (not shown).

In a special embodiment (not shown), the wings 3 are rotatably arranged on one or more radial guide shafts in the shell body 2, which radial guide shafts are arranged on the axial guide shafts. The special embodiment allows the angle of incidence of the wings 3 to be adjusted for correction of the shell 1 during the final phase of the shell 1.

Figure 3:
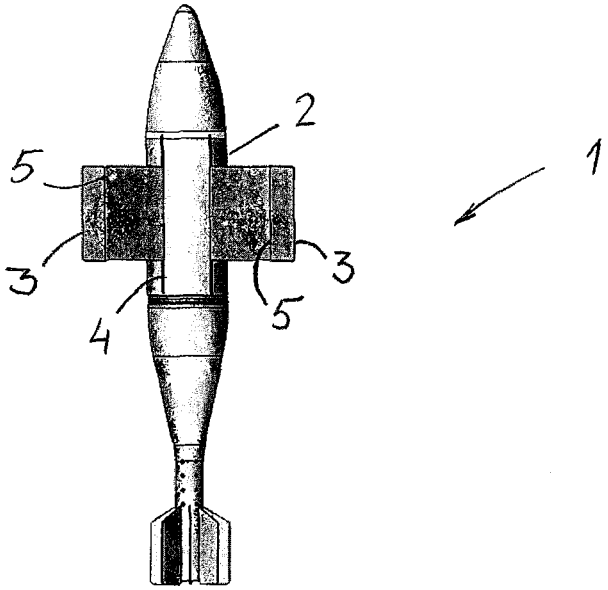
FIG. 3 shows in schematic representation a side view of a shell according to FIG. 2, wherein the wings are adjusted for normal flight position.
Figure 4:
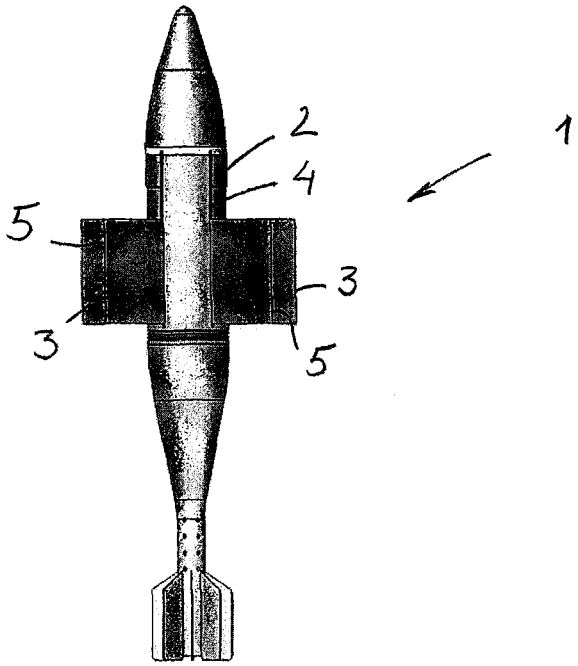
FIG. 4 shows in schematic representation a side view of a shell according to FIG. 2, wherein the wings are adjusted for high speed during the final phase of the shell.
Figure 5:
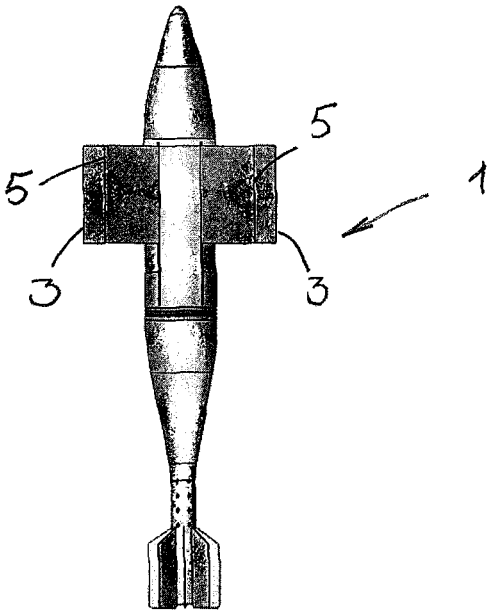
FIG. 5 shows in schematic representation a side view of a shell according to FIG. 2, wherein the wings are adjusted for low speed.
Figure 6:
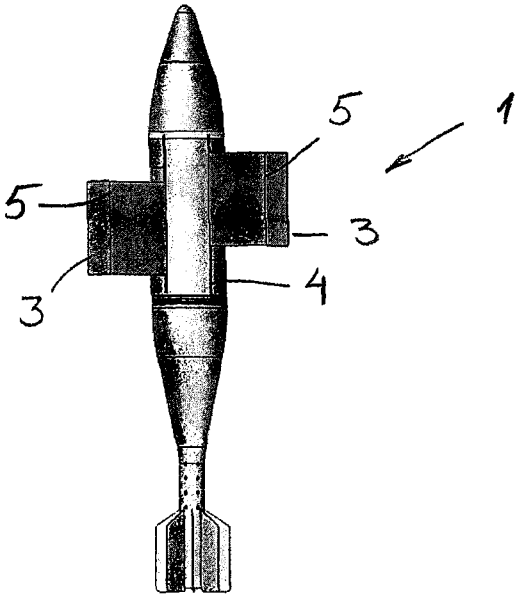
FIG. 6 shows in schematic representation a side view of a shell according to FIG. 2, wherein the wings are adjusted for left-hand turn.

FIGS. 3 to 6 shows the positions of the wings 3 in the axial direction in different guidance situations. FIG. 3 shows the wings 3 adjusted for normal flight position during the gliding phase of the shell 1. FIG. 4 shows the wings adjusted for high speed during the final phase of the shell, and FIG. 5 shows the wings 3 adjusted for low speed during the gliding phase of the shell. Finally, FIG. 6 shows the wings 3 adjusted for left-hand turn.

The invention is not limited to the embodiments shown, but can be varied in different ways within the scope of the patent claims.

It will further be appreciated that the number, size, material and shape of those elements and components which form part of the shell 1 and are of importance to the invention, for example wings, spring mechanisms, release mechanism, fastening devices, can be adapted with regard to one another and with regard to other constituent elements and components, and also with regard to the enemy target or targets which is/are meant to be combatted.

The invention claimed is:

1. A mortar shell arranged with extensible wings having improved guidance characteristics during the gliding and final phase of the shell, characterized in that the extensible wings, via threaded wing fixtures, are movably arranged on rotatable axial guide shafts on the shell body for separate or simultaneous displacement of the wings in the longitudinal direction of the shell, for guidance of the shell in the lateral direction during the gliding phase of the shell, and in that the wings are also rotatably arranged on radial guide shafts for controlling the angle of incidence of the wings during the final phase of the shell.

2. A shell according to claim 1, wherein the wings are refracted against the shell body during firing of the shell, and in that the wings are extended from the shell body when a release mechanism is activated.

3. A shell according to claim 2, wherein the release mechanism is activated on a preprogrammed basis via a programmable command and control unit arranged in the shell body.

4. A shell according to claim 3, wherein the release mechanism is activated by remote control in response to an activation signal from a ground-based transmitter.

5. A shell according to claim 4, wherein the release mechanism is electromechanical is activated on a preprogrammed basis via a programmable command and control unit arranged in the shell body.

6. A shell according to claim 5, wherein the release mechanism is pyrotechnic.

7. A shell according to claim 6, wherein the wings are hinged to allow the shape of the wings to be adapted to the shape of the shell body when the wings are retracted against the shell body.

8. A shell according to claim 5, wherein the wings are hinged to allow the shape of the wings to be adapted to the shape of the shell body when the wings are retracted against the shell body.

9. A shell according to claim 4, wherein the release mechanism is pyrotechnic.

10. A shell according to claim 4, wherein the wings are hinged to allow the shape of the wings to be adapted to the shape of the shell body when the wings are retracted against the shell body.

11. A shell according to claim 3, wherein the release mechanism is electromechanical.

12. A shell according to claim 11, wherein the release mechanism is pyrotechnic.

13. A shell according to claim 11, wherein the wings are hinged to allow the shape of the wings to be adapted to the shape of the shell body when the wings are retracted against the shell body.

14. A shell according to claim 3, wherein the release mechanism is pyrotechnic.

15. A shell according to claim 14, wherein the wings are hinged to allow the shape of the wings to be adapted to the shape of the shell body when the wings are retracted against the shell body.

16. A shell according to claim 3, wherein the wings are hinged to allow the shape of the wings to be adapted to the shape of the shell body when the wings are retracted against the shell body.

17. A shell according to claim 2, wherein the wings are hinged to allow the shape of the wings to be adapted to the shape of the shell body when the wings are retracted against the shell body.

18. A shell according to claim 1, wherein the wings are hinged to allow the shape of the wings to be adapted to the shape of the shell body when the wings are retracted against the shell body.

19. A shell according to claim 1, wherein rotation of the axial guide shafts is effected with electric motors, the torgue of which is transferred to the guide shafts via flexible rotary shafts.

20. A shell according to claim 19, wherein activation of the electric motors is realized in response to control signals from a ground-based transmitter via the programmable command and control unit.

* * * * *